US012258520B2

(12) United States Patent
Fujiwara et al.

(10) Patent No.: US 12,258,520 B2
(45) Date of Patent: Mar. 25, 2025

(54) PYROLYSIS APPARATUS AND PYROLYSIS METHOD

(71) Applicant: EBARA ENVIRONMENTAL PLANT CO., LTD., Tokyo (JP)

(72) Inventors: Takashi Fujiwara, Tokyo (JP); Takayuki Ihara, Tokyo (JP)

(73) Assignee: EBARA ENVIRONMENTAL PLANT CO., LTD., Tokyo (JP)

( * ) Notice: Subject to any disclaimer, the term of this patent is extended or adjusted under 35 U.S.C. 154(b) by 223 days.

(21) Appl. No.: 17/786,102

(22) PCT Filed: Dec. 7, 2020

(86) PCT No.: PCT/JP2020/045453
§ 371 (c)(1),
(2) Date: Jun. 16, 2022

(87) PCT Pub. No.: WO2021/131634
PCT Pub. Date: Jul. 1, 2021

(65) Prior Publication Data

US 2023/0025336 A1 Jan. 26, 2023

(30) Foreign Application Priority Data

Dec. 27, 2019 (JP) ..... 2019-238494

(51) Int. Cl.
*C10B 49/10* (2006.01)
*C10B 53/00* (2006.01)
(Continued)

(52) U.S. Cl.
CPC ..... *C10B 49/10* (2013.01); *C10B 53/07* (2013.01); *C10B 57/02* (2013.01); *C10G 1/10* (2013.01);
(Continued)

(58) Field of Classification Search
CPC ..... C10B 47/24; C10B 49/10; C10J 2300/09–095; C10J 2300/0903;
(Continued)

(56) References Cited

U.S. PATENT DOCUMENTS 5,365,889 A 11/1994 Tang
8,372,169 B2 * 2/2013 Tsangaris ..... C10K 3/008 48/89
(Continued)

FOREIGN PATENT DOCUMENTS

CN 1284986 A 2/2001
CN 1286749 A 3/2001
(Continued)

OTHER PUBLICATIONS

Espacenent translation of JP 2003-156209 A.*
(Continued)

*Primary Examiner* — Jonathan Luke Pilcher
(74) *Attorney, Agent, or Firm* — Leydig, Voit & Mayer, Ltd.

(57) ABSTRACT

The pyrolysis apparatus includes a fluid bed furnace (1), a first partition wall (11) dividing inside of the fluid bed furnace (1) into a pyrolysis chamber (4) and a combustion chamber (5), a second partition wall (12) dividing the combustion chamber (5) into a main combustion chamber (6) and a settling combustion chamber (7), a first gas diffuser (15), a second gas diffuser (25), and a third gas diffuser (35) configured to supply a first fluidizing gas, a second fluidizing gas, and a third fluidizing gas to the pyrolysis chamber (4), the main combustion chamber (6), and the settling combustion chamber (7), respectively, a first raw-material supply device (71) configured to supply a first raw material to the pyrolysis chamber (4) with a first supply amount, a second raw-material supply device (72) configured to supply a
(Continued)

second raw material to the pyrolysis chamber (4) with a second supply amount, and an operation controller (200) configured to independently control operations of the first raw-material supply device (71) and the second raw-material supply device (72).

8 Claims, 7 Drawing Sheets

(51) Int. Cl.

| | |
|---|---|
| ***C10B 53/07*** | (2006.01) |
| ***C10B 57/02*** | (2006.01) |
| ***C10G 1/10*** | (2006.01) |
| ***C10J 3/56*** | (2006.01) |
| ***F23C 10/00*** | (2006.01) |
| ***F23C 10/28*** | (2006.01) |
| ***F23G 5/027*** | (2006.01) |
| ***F23G 5/30*** | (2006.01) |

(52) U.S. Cl.
CPC ..... *C10J 3/56* (2013.01); *F23G 5/0276* (2013.01); *F23G 5/30* (2013.01); *C10G 2300/1003* (2013.01); *C10J 2200/15* (2013.01); *C10J 2300/0903* (2013.01); *C10J 2300/0946* (2013.01); *F23C 10/005* (2013.01); *F23C 10/28* (2013.01)

(58) Field of Classification Search
CPC . C10J 2300/0906; F23C 10/005; F23C 10/28; F23C 10/30; F23G 5/30
See application file for complete search history.

(56) References Cited

U.S. PATENT DOCUMENTS

| | | | | |
|---|---|---|---|---|
| 9,109,172 | B2 * | 8/2015 | Tsangaris | C10K 1/003 |
| 2008/0209807 | A1 * | 9/2008 | Tsangaris | C10J 3/82 48/89 |
| 2013/0269252 | A1 * | 10/2013 | Tsangaris | C10K 1/16 48/209 |

FOREIGN PATENT DOCUMENTS

| | | | | |
|---|---|---|---|---|
| CN | 107723012 | A | | 2/2018 |
| JP | H10-002543 | A | | 1/1998 |
| JP | H11-181450 | A | | 7/1999 |
| JP | 2002-129169 | A | | 5/2002 |
| JP | 2003-156209 | A | | 5/2003 |
| JP | 2003-171673 | A | | 6/2003 |
| JP | 2004196831 | A | * | 7/2004 |
| JP | 3611306 | B2 | | 1/2005 |
| JP | 2006-063290 | A | | 3/2006 |
| JP | 2007-024492 | A | | 2/2007 |
| JP | 4243919 | B2 | | 3/2009 |
| JP | 4283222 | B2 | | 6/2009 |
| WO | WO 2005/033250 | A2 | | 4/2005 |
| WO | WO 2019/239270 | A2 | | 12/2019 |

OTHER PUBLICATIONS

Espacenet English Translation of JP 2004196831 A.*
Espacenet English Translation of JP 4283222 B2.*
Espacenet English Translation of CN 1284986 A.*
Japanese Patent Office, International Search Report in International Patent Application No. PCT/JP2020/045453 (Jan. 19, 2021).
European Patent Office, Supplementary European Search Report issued in European Patent Application No. 20905304.0 (Jan. 9, 2024).

* cited by examiner

PYROLYSIS APPARATUS AND PYROLYSIS METHOD

TECHNICAL FIELD

The present invention relates to a pyrolysis apparatus and a pyrolysis method for pyrolyzing a raw material in a fluidized-bed furnace, and more particularly to a pyrolysis apparatus and a pyrolysis method for pyrolyzing a raw material using an internally circulating fluidized-bed gasification technique to obtain a pyrolysis product.

BACKGROUND ART

A fluidized-bed furnace is a treatment system in which a raw material, such as municipal waste or industrial waste, is pyrolyzed, then gasified, and combusted. A fluidized-bed furnace disclosed in patent documents 1 and 2 has a structure in which the inside of the furnace is divided into a gasification chamber and a combustion chamber by a partition wall. A raw material is introduced into the gasification chamber, while a fluidized medium circulates between the gasification chamber and the combustion chamber. The raw material is heated by the fluidized medium in the gasification chamber, pyrolyzed, and then gasified. A residue of the raw material is carried into the combustion chamber by the fluidized medium. The residue of the raw material combusts in the combustion chamber to heat the fluidized medium. The heated fluidized medium moves into the gasification chamber and functions as a heat source in the gasification chamber. Such fluidized-bed furnace in which the fluidized medium circulates in the furnace is known as an internally circulating fluidized-bed gasification system.

A waste plastic is usually incinerated and treated by an incinerator. Recently, from a standpoint of suppressing an emission of carbon dioxide, there is an increasing demand for recovering oil by pyrolyzing the waste plastic (patent documents 3 and 4). However, it is difficult to recover the oil in a high yield, and the reality is that there are few examples of commercial success. The above-described internally circulating fluidized-bed gasification system is expected as a technology that can recover an organic compound, which is liquid at normal temperature and normal pressure, i.e., oil, as a pyrolysis product, by heating and pyrolyzing the waste plastic in the gasification chamber.

However, the waste plastic has a high carbon content, and a large amount of carbide (char) is generated after pyrolysis. This unburned carbon cannot be recovered as oil and must be burned in the combustion chamber. As a result, the emission of the carbon dioxide increases, while the yield of the pyrolysis product is lowed.

The internally circulating fluidized-bed gasification system is also attracting attention as a technology for recovering various substances including oil. In order to pyrolyze the raw material in the gasification chamber and recover a target substance as a pyrolysis product, it is necessary to heat the raw material in the gasification chamber at an appropriate temperature. However, the hot fluidized medium that has moved from the combustion chamber forms a local hot region in the gasification chamber. Therefore, a part of the raw material may be excessively heated by the high-temperature fluidized medium, and an unintended substance may be generated. For example, the pyrolysis of the waste plastic is accelerated as temperature rises, and forms gas, which is a gas at normal temperature. As a result, a yield of oil, which is a liquid at normal temperature, is lowed.

Further, a transfer rate to carbide (char) increases as temperature rises, and a yield of the pyrolysis product is lowed.

The above-described internally circulating fluidized-bed gasification system can also be used for pyrolyzing combustible material, such as biomass, municipal waste, and organic waste, and recovering a useful substance as a pyrolysis product. However, in general, the biomass and the municipal waste have a relatively low content rate of carbon (C) compared to oxygen (O) and hydrogen (H), and a large amount of heat is required to burn these combustible materials in the combustion chamber. Therefore, most of the carbon contained in the combustible material is transferred to the combustion chamber and consumed for combustion in the combustion chamber. As a result, a yield of carbon is lowed in the gasification chamber.

CITATION LIST

Patent Literature

Patent document 1: Japanese Patent No. 4243919

Patent document 2: Japanese laid-open patent publication No. 10-2543

Patent document 3: Japanese laid-open patent publication No. 2002-129169

Patent document 4: Japanese Patent No. 3611306

SUMMARY OF INVENTION

Technical Problem

Therefore, the present invention provides a pyrolysis apparatus and a pyrolysis method capable of increasing a yield of an intended pyrolysis product.

Solution to Problem

In an embodiment, there is provided a pyrolysis apparatus for pyrolyzing a raw material in a fluidized bed formed of a fluidized medium, comprising: a fluidized-bed furnace; a first partition wall dividing inside of the fluidized-bed furnace into a pyrolysis chamber and a combustion chamber; a second partition wall dividing the combustion chamber into a main combustion chamber and a settling combustion chamber; a first gas diffuser, a second gas diffuser, and a third gas diffuser configured to supply a first fluidizing gas, a second fluidizing gas, and a third fluidizing gas to the pyrolysis chamber, the main combustion chamber, and the settling combustion chamber, respectively; a first raw-material supply device configured to supply a first raw material to the pyrolysis chamber with a first supply amount; a second raw-material supply device configured to supply a second raw material to the pyrolysis chamber with a second supply amount, the second raw material having a lower ratio of carbon to hydrogen and a lower ratio of carbon to oxygen than those of the first raw material; and an operation controller configured to independently control operations of the first raw-material supply device and the second raw-material supply device.

In an embodiment, the operation controller is configured to regulate a ratio of the first supply amount to the second supply amount based on a temperature in the main combustion chamber or a temperature in the settling combustion chamber.

In an embodiment, the pyrolysis apparatus further comprises: a third raw-material supply device configured to supply the first raw material to the main combustion chamber; and a fourth raw-material supply device configured to supply the second raw material to the main combustion chamber.

In an embodiment, the operation controller is configured to control an operation of the third gas diffuser such that a temperature in the settling combustion chamber is within a predetermined temperature range.

In an embodiment, the third gas diffuser includes: a wind box disposed under the settling combustion chamber; a fluidizing-gas supply line coupled to the wind box; a temperature regulator attached to the fluidizing-gas supply line; and a gas flow-rate regulating valve attached to the fluidizing-gas supply line, and the operation controller is configured to control an operation of at least one of the temperature regulator and the gas flow-rate regulating valve such that the temperature in the settling combustion chamber is within the predetermined temperature range.

In an embodiment, the pyrolysis apparatus further comprises a heat recovery device configured to recover heat from a fluidized medium in the settling combustion chamber, wherein the operation controller is configured to control an operation of the heat recovery device such that a temperature in the settling combustion chamber is within a predetermined temperature range.

In an embodiment, the heat recovery device includes: a heat transfer tube disposed in the settling combustion chamber; and a refrigerant flow-rate regulating valve configured to regulate a flow rate of a cooling medium flowing in the heat transfer tube, and the operation controller is configured to control an operation of the refrigerant flow-rate regulating valve such that the temperature in the settling combustion chamber is within the predetermined temperature range.

In an embodiment, the third gas diffuser includes: a plurality of wind boxes disposed under the settling combustion chamber; a plurality of fluidizing-gas supply lines coupled to the plurality of wind boxes, respectively; and a plurality of gas flow-rate regulating valves attached to the plurality of fluidizing-gas supply lines, respectively, and the operation controller is configured to control operations of the plurality of gas flow-rate regulating valves such that opening degrees of the plurality of gas flow-rate regulating valves are different from each other.

In an embodiment, the first gas diffuser includes at least one first fluidizing-gas supply source configured to supply the first fluidizing gas to the pyrolysis chamber, and the first fluidizing-gas supply source includes at least one supply source configured to supply at least one of carbon monoxide gas, carbon dioxide gas, hydrogen gas, hydrocarbon gas, vapor, and nitrogen gas.

In an embodiment, there is provided a pyrolysis apparatus for pyrolyzing a raw material in a fluidized bed formed of a fluidized medium, comprising: a fluidized-bed furnace; a first partition wall dividing inside of the fluidized-bed furnace into a pyrolysis chamber and a combustion chamber; a second partition wall dividing the combustion chamber into a main combustion chamber and a settling combustion chamber; a first gas diffuser, a second gas diffuser, and a third gas diffuser configured to supply a first fluidizing gas, a second fluidizing gas, and a third fluidizing gas to the pyrolysis chamber, the main combustion chamber, and the settling combustion chamber, respectively; a raw-material supply device configured to supply a raw material to the pyrolysis chamber; a settling-combustion-chamber thermometer configured to measure a temperature in the settling combustion chamber; and an operation controller configured to control the temperature in the settling combustion chamber.

In an embodiment, the operation controller is configured to control an operation of the third gas diffuser such that a measured value of the temperature in the settling combustion chamber is within a predetermined temperature range.

In an embodiment, the third gas diffuser includes: a wind box disposed under the settling combustion chamber; a fluidizing-gas supply line coupled to the wind box; a temperature regulator attached to the fluidizing-gas supply line; and a gas flow-rate regulating valve attached to the fluidizing-gas supply line, and the operation controller is configured to control an operation of at least one of the temperature regulator and the gas flow-rate regulating valve such that the measured value of the temperature in the settling combustion chamber is within the predetermined temperature range.

In an embodiment, the pyrolysis apparatus further comprises a heat recovery device configured to recover heat from a fluidized medium in the settling combustion chamber, wherein the operation controller is configured to control an operation of the heat recovery device such that a measured value of the temperature in the settling combustion chamber is within a predetermined temperature range.

In an embodiment, the heat recovery device includes: a heat transfer tube disposed in the settling combustion chamber; and a refrigerant flow-rate regulating valve configured to regulate a flow rate of a cooling medium flowing in the heat transfer tube, and the operation controller is configured to control an operation of the refrigerant flow-rate regulating valve such that the measured value of the temperature in the settling combustion chamber is within the predetermined temperature range.

In an embodiment, the third gas diffuser includes: a plurality of wind boxes disposed under the settling combustion chamber; a plurality of fluidizing-gas supply lines coupled to the plurality of wind boxes, respectively; and a plurality of gas flow-rate regulating valves attached to the plurality of fluidizing-gas supply lines, respectively, and the operation controller is configured to control operations of the plurality of gas flow-rate regulating valves such that opening degrees of the plurality of gas flow-rate regulating valves are different from each other.

In an embodiment, the third gas diffuser includes a fluidizing-gas supply source configured to supply the third fluidizing gas to the settling combustion chamber, and the fluidizing-gas supply source includes at least one supply source configured to supply at least one of carbon monoxide gas, carbon dioxide gas, hydrogen gas, hydrocarbon gas, vapor, and nitrogen gas.

In an embodiment, there is provided a pyrolysis method of pyrolyzing a raw material using a pyrolysis apparatus having a fluidized-bed furnace containing a fluidized medium therein, inside of the fluidized-bed furnace being divided into a pyrolysis chamber, a main combustion chamber, and a settling combustion chamber, said method comprising: supplying a first fluidizing gas to the pyrolysis chamber to form a first fluidized bed in the pyrolysis chamber; supplying a first raw material to the pyrolysis chamber with a first supply amount, while supplying a second raw material to the pyrolysis chamber with a second supply amount, the second raw material having a lower ratio of carbon to hydrogen and a lower ratio of carbon to oxygen than those of the first raw material; pyrolyzing the first raw material and the second raw material in the pyrolysis chamber; combusting a residue of the first raw material and a residue of the second raw material in the main combustion chamber, while supplying a second fluidizing gas to the main combustion chamber to form a second fluidized bed in the main combustion chamber; and moving a fluidized medium from the main combustion chamber to the pyrolysis chamber through the settling combustion chamber, while supplying a third fluidizing gas to the settling combustion chamber to form a third fluidized bed in the settling combustion chamber.

In an embodiment, the pyrolysis method further comprises controlling a ratio of the first supply amount to the second supply amount based on a temperature in the main combustion chamber or a temperature in the settling combustion chamber.

In an embodiment, the pyrolysis method further comprises supplying at least one of the first raw material and the second raw material to the main combustion chamber, while supplying the first raw material and the second raw material to the pyrolysis chamber.

In an embodiment, the pyrolysis method further comprises regulating a temperature or a flow rate of the third fluidizing gas such that a temperature in the settling combustion chamber is within a predetermined temperature range.

In an embodiment, a heat transfer tube through which a cooling medium flows is disposed in the settling combustion chamber, and the pyrolysis method further comprises regulating a flow rate of the cooling medium such that a temperature in the settling combustion chamber is within a predetermined temperature range.

In an embodiment, the third fluidizing gas is supplied into the settling combustion chamber at different flow rates from a plurality of wind boxes disposed under the settling combustion chamber to swirl the fluidized medium forming the third fluidized bed.

In an embodiment, the first fluidizing gas contains at least one of carbon monoxide gas, carbon dioxide gas, hydrogen gas, hydrocarbon gas, vapor, and nitrogen gas.

In an embodiment, there is provided a pyrolysis method of pyrolyzing a raw material using a pyrolysis apparatus having a fluidized-bed furnace containing a fluidized medium therein, inside of the fluidized-bed furnace being divided into a pyrolysis chamber, a main combustion chamber, and a settling combustion chamber, said method comprising: supplying a first fluidizing gas to the pyrolysis chamber to form a first fluidized bed in the pyrolysis chamber; supplying a raw material to the pyrolysis chamber; pyrolyzing the raw material in the pyrolysis chamber; combusting a residue of the raw material in the main combustion chamber, while supplying a second fluidizing gas to the main combustion chamber to form a second fluidized bed in the main combustion chamber; moving a fluidized medium from the main combustion chamber to the pyrolysis chamber through the settling combustion chamber, while supplying a third fluidizing gas to the settling combustion chamber to form a third fluidized bed in the settling combustion chamber; and controlling a temperature of the settling combustion chamber within a predetermined temperature range.

In an embodiment, the pyrolysis method further comprises regulating a temperature or a flow rate of the third fluidizing gas such that the temperature in the settling combustion chamber is within the predetermined temperature range.

In an embodiment, a heat transfer tube through which a cooling medium flows is disposed in the settling combustion chamber, and the pyrolysis method further comprises regulating a flow rate of the cooling medium such that the temperature in the settling combustion chamber is within the predetermined temperature range.

In an embodiment, the third fluidizing gas is supplied into the settling combustion chamber at different flow rates from a plurality of wind boxes disposed under the settling combustion chamber to swirl the fluidized medium forming the third fluidized bed.

Advantageous Effects of Invention

According to an embodiment of the present invention, the first raw material having the high ratio of carbon to hydrogen (carbon/hydrogen ratio) and the high ratio of carbon to oxygen (carbon/oxygen ratio), and the second raw material having the lower ratios than those of the first raw material are supplied simultaneously into the pyrolysis chamber. A thermal energy generated from the residue of the first raw material can sufficiently heat the fluidized medium in the main combustion chamber. Therefore, an amount of heat that the residue of the second raw material should have in the main combustion chamber can be low. As a result, a yield of pyrolysis product from the second raw material is improved. The heated fluidized medium moves from the main combustion chamber to the pyrolysis chamber through the settling combustion chamber, and pyrolyzes the first raw material and the second raw material.

According to an embodiment of the present invention, the temperature of the fluidized medium is regulated in advance, and the fluidized medium then moves to the pyrolysis chamber, so that a local high temperature region is not formed in the pyrolysis chamber. Therefore, the raw material is heated within an appropriate temperature range in the pyrolysis chamber, and as a result, the yield of the desired pyrolysis product (e.g., oil) can be improved.

DESCRIPTION OF EMBODIMENTS

Embodiments of the present invention will now be described with reference to the drawings.

Figure 1:
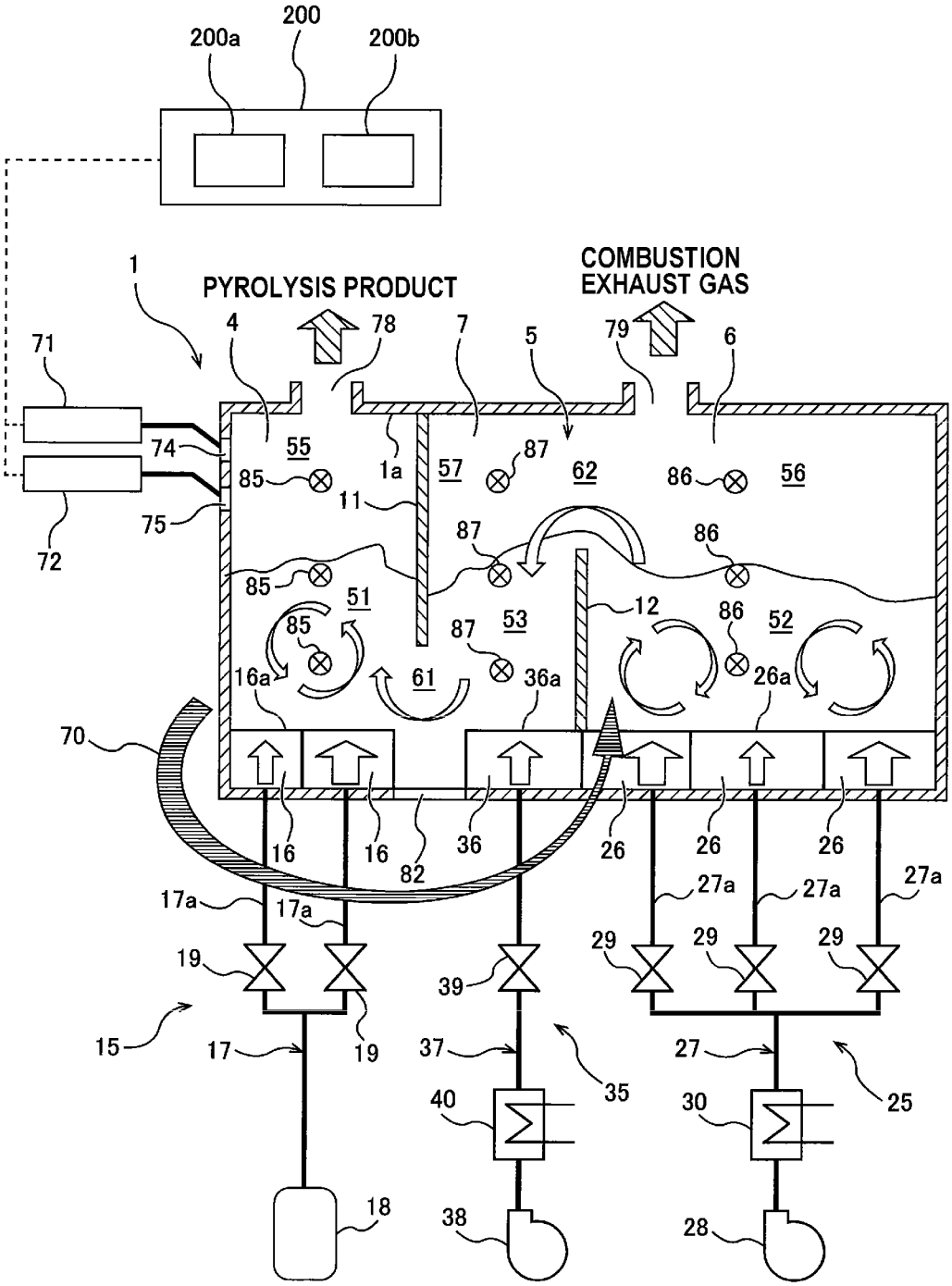
FIG. 1 is a diagram showing an embodiment of a pyrolysis apparatus.

FIG. 1 is a diagram showing an embodiment of a pyrolysis apparatus. The pyrolysis apparatus shown in FIG. 1 includes a pyrolysis chamber 4 configured to pyrolyze a raw material to generate a pyrolysis product, and a combustion chamber 5 configured to burn a residue of the pyrolyzed raw material. The pyrolysis chamber 4 and the combustion chamber 5 are formed in one fluidized-bed furnace 1. Specifically, the inside of the fluidized-bed furnace 1 is divided into the pyrolysis chamber 4 and the combustion chamber 5 by a first partition wall 11, and the combustion chamber 5 is further divided into a main combustion chamber 6 and a settling combustion chamber 7 by a second partition wall 12. An entire shape of the fluidized-bed furnace 1 is not particularly limited, and the fluidized-bed furnace 1 may have, e.g., a cylindrical shape or a rectangular shape.

A fluidized medium (e.g., silica sand) is contained in the pyrolysis chamber 4, the main combustion chamber 6, and the settling combustion chamber 7. In order to fluidize the fluidized medium, the pyrolysis chamber 4, the main combustion chamber 6, and the settling combustion chamber 7 are coupled to a first gas diffuser 15, a second gas diffuser 25, and a third gas diffuser 35, respectively. The first gas diffuser 15, the second gas diffuser 25, and the third gas diffuser 35 blow a first fluidizing gas, a second fluidizing gas, and a third fluidizing gas into the pyrolysis chamber 4, the main combustion chamber 6, and the settling combustion chamber 7, respectively and independently, so that the fluidized medium in each of the chambers 4, 5 and 7 is fluidized. The fluidized medium forms a first fluidized bed 51, a second fluidized bed 52, and a third fluidized bed 53 in the pyrolysis chamber 4, the main combustion chamber 6, and the settling combustion chamber 7. Above the first fluidized bed 51, the second fluidized bed 52, and the third fluidized bed 53, there are a freeboard section 55, a freeboard section 56, and a freeboard section 57 in which almost no fluidized medium is present.

The first gas diffuser 15 includes a plurality of (two in FIG. 1) first wind boxes 16 under the pyrolysis chamber 4, a first fluidizing-gas supply line 17 coupled to these first wind boxes 16, a first fluidizing-gas supply source 18 coupled to the first fluidizing-gas supply line 17, and a plurality of (two in FIG. 1) first gas flow-rate regulating valves (or first gas flow-rate regulating dampers) 19 attached to the first fluidizing-gas supply line 17. The first fluidizing-gas supply line 17 has a plurality of first branch lines 17*a*, and the first gas flow-rate regulating valves 19 are attached to these first branch lines 17*a*, respectively. An upper wall of the first wind box 16 is formed of a porous plate 16*a*. The porous plate 16*a* constitutes a furnace floor of the pyrolysis chamber 4.

In this embodiment, water vapor is used as the first fluidizing gas. A boiler configured to generate water vapor is used as the first fluidizing-gas supply source 18. In one embodiment, air may be used as the first fluidizing gas. In this case, the first gas diffuser 15 may include a blower as the first fluidizing-gas supply source 18. Further, the first gas diffuser 15 may include a temperature regulator for heating the first fluidizing gas. The temperature regulator is attached to the first fluidizing-gas supply line 17.

The second gas diffuser 25 includes a plurality of (three in FIG. 1) second wind boxes 26, a second fluidizing-gas supply line 27 coupled to these second wind boxes 26, a second fluidizing-gas supply source 28 coupled to the second fluidizing-gas supply line 27, a plurality of (three in FIG. 1) second gas flow-rate regulating valves (or second gas flow-rate regulating dampers) 29 attached to the second fluidizing-gas supply line 27, and a second temperature regulator 30 attached to the second fluidizing-gas supply line 27. The second fluidizing-gas supply line 27 has a plurality of second branch lines 27*a*, and the second gas flow-rate regulating valves 29 are attached to these second branch lines 27*a*, respectively. An upper wall of the second wind box 26 is formed of a porous plate 26*a*. The porous plate 26*a* constitutes a furnace floor of the main combustion chamber 6.

The third gas diffuser 35 includes at least one third wind box 36, at least one third fluidizing-gas supply line 37 coupled to the third wind box 36, a third fluidizing-gas supply source 38 coupled to the third fluidizing-gas supply line 37, at least one third gas flow-rate regulating valve (or third gas flow-rate regulating damper) 39 attached to the third fluidizing-gas supply line 37, and a third temperature regulator 40 attached to the third fluidizing-gas supply line 37. An upper wall of the third wind box 36 is formed of a porous plate 36*a*. The porous plate 36*a* constitutes a furnace floor of the settling combustion chamber 7.

Sizes of white arrows shown in the wind boxes 16, 26, and 36 indicate flow velocities of the fluidizing gas to be blown out. Due to the difference in the flow velocity of the fluidizing gas, a swirling flow of the fluidized medium is formed in the pyrolysis chamber 4, and a swirling flow of the fluidized medium is formed in the main combustion chamber 6. The first fluidized bed 51 is formed of the swirling fluidized medium, and the second fluidized bed 52 is also formed of the swirling fluidized medium. On the other hand, the third fluidized bed 53 in the settling combustion chamber 7 is formed of a descending flow of the fluidized medium. In one embodiment, the third fluidized bed 53 may also be formed of a swirling fluidized bed.

In the present embodiment, air is used for the second fluidizing gas and the third fluidizing gas supplied to the main combustion chamber 6 and the settling combustion chamber 7. Each of the second fluidizing-gas supply source 28 and the third fluidizing-gas supply source 38 is constituted by a blower. However, the present invention is not limited to the present embodiment, and other type of gas may be used as the second fluidizing gas and the third fluidizing gas. For example, the second fluidizing-gas supply source 28 may include at least one supply source for supplying at least one of carbon dioxide gas, vapor, nitrogen gas, and oxygen. The third fluidizing-gas supply source 38 may include at least one supply source for supplying at least one of carbon monoxide gas, carbon dioxide gas, hydrogen gas, hydrocarbon gas, vapor, and nitrogen gas.

In the embodiment shown in FIG. 1, the second fluidizing-gas supply source 28 and the third fluidizing-gas supply source 38 are coupled to the second fluidizing-gas supply line 27 and the third fluidizing-gas supply line 37, respectively. However, in one embodiment, a common fluidizing-gas supply source may be coupled to the second fluidizing-gas supply line 27 and the third fluidizing-gas supply line 37. In this case, instead of the second temperature regulator 30 and the third temperature regulator 40, a common temperature regulator may be attached to the second fluidizing-gas supply line 27 and the third fluidizing-gas supply line 37.

The pyrolysis chamber 4, the main combustion chamber 6, and the settling combustion chamber 7 as a whole constitute one fluidized-bed furnace 1. The first partition wall 11 extends downward from an upper wall la of the fluidized-bed furnace 1. A lower end of the first partition wall 11 is not in contact with the furnace floor, and there is a first opening 61 under the first partition wall 11. This first opening 61 is located at a bottom of the pyrolysis chamber 4 and the settling combustion chamber 7. The pyrolysis chamber 4 and the settling combustion chamber 7 communicate with each other through the first opening 61. Therefore, the first opening 61 allows the fluidized medium heated in the main combustion chamber 6 to move into the pyrolysis chamber 4 through the settling combustion chamber 7. The first opening 61 is located lower than interfaces (or upper surfaces) of the first fluidized bed 51 and the third fluidized bed 53 in the pyrolysis chamber 4 and the settling combustion chamber 7.

The second partition wall 12 extends upward from the furnace floor of the combustion chamber 5 (i.e., the main combustion chamber 6 and settling combustion chamber 7).

An upper end of the second partition wall 12 is not coupled to the upper wall la of the fluidized-bed furnace 1, and there is a second opening 62 over the second partition wall 12. The second opening 62 is located in the freeboard section 56 of the main combustion chamber 6 and the freeboard section 57 of the settling combustion chamber 7. The main combustion chamber 6 and the settling combustion chamber 7 communicate with each other through the second opening 62. More specifically, the freeboard section 56 of the main combustion chamber 6 and the freeboard section 57 of the settling combustion chamber 7 communicate with each other through the second opening 62.

Two regions having different flow velocities of the fluidized medium, i.e., a weak fluidizing zone and an intense fluidizing zone, are formed in the main combustion chamber 6. The weak fluidizing zone is formed in a center of the main combustion chamber 6, and the intense fluidizing zone is formed outside the weak fluidizing zone. Therefore, a descending flow of the fluidized medium is formed in the central region of the main combustion chamber 6, and an ascending flow of the fluidized medium is formed in the outer region of the main combustion chamber 6. These ascending flow and descending flow of the fluidized medium form a swirling flow of the fluidized medium in the main combustion chamber 6. The second fluidized bed 52 is formed from such swirling flow of the fluidized medium.

A part of the fluidized medium forming the swirling flow in the main combustion chamber 6 overflows the upper end of the second partition wall 12 into the settling combustion chamber 7 through the second opening 62. The fluidized medium forms the third fluidized bed 53 while descending in the settling combustion chamber 7. Further, the fluidized medium flows from the settling combustion chamber 7 through the first opening 61 into the pyrolysis chamber 4, and is mixed with the fluidized medium forming the first fluidized bed 51. In the pyrolysis chamber 4, the fluidized medium forms a swirling flow. The fluidized medium forming this swirling flow ascends along the first partition wall 11, and this ascending flow induces the fluidized medium in the settling combustion chamber 7 into the pyrolysis chamber 4.

The pyrolysis chamber 4 and the main combustion chamber 6 communicate with each other through a communication passage 70. In FIG. 1, an arrow indicating the communication passage 70 is illustrated outside the fluidized-bed furnace 1, but the communication passage 70 is located in the fluidized-bed furnace 1. In addition, in FIG. 1, the pyrolysis chamber 4, the main combustion chamber 6, and the settling combustion chamber 7 are illustrated in a plane, but these chambers 4, 6 and 7 actually have a three-dimensional shape. The pyrolysis chamber 4 may be arranged next to both the main combustion chamber 6 and the settling combustion chamber 7. Therefore, the communication passage 70 may be composed of a simple opening.

The pyrolysis apparatus includes a first raw-material supply device 71 and a second raw-material supply device 72 configured to supply a first raw material and a second raw material into the pyrolysis chamber 4. A raw-material outlet of the first raw-material supply device 71 is coupled to the pyrolysis chamber 4, and a raw-material inlet of the first raw-material supply device 71 is coupled to a transporting device (not shown) configured to transport the first raw material. Similarly, a raw-material outlet of the second raw-material supply device 72 is coupled to the pyrolysis chamber 4, and a raw-material inlet of the second raw-material supply device 72 is coupled to a transporting device (not shown) configured to transport the second raw material. Specific examples of the first raw-material supply device 71 and the second raw-material supply device 72 include a screw feeder capable of quantitatively feeding the raw material into the pyrolysis chamber 4.

In the embodiment shown in FIG. 1, the first raw material and the second raw material are fed from the first raw-material supply device 71 and the second raw-material supply device 72 through two supply ports 74 and 75, provided in the freeboard section 55 of the pyrolysis chamber 4, into the pyrolysis chamber 4. In FIG. 1, these two supply ports 74 and 75 are schematically illustrated. In one embodiment, the first raw material and the second raw material may be mixed after being delivered from the first raw-material supply device 71 and the second raw-material supply device 72, and the mixture of the first raw material and the second raw material may be fed through one supply port into the pyrolysis chamber 4.

The first raw material and the second raw material that have been fed into the pyrolysis chamber 4 receive heat from the fluidized medium and are pyrolyzed, while being agitated by the swirling flow of the fluidized medium forming the first fluidized bed 51. As a result of the pyrolysis, a part of components contained in the first raw material and the second raw material form a pyrolysis product. The pyrolysis product is discharged from the pyrolysis chamber 4 through a product outlet 78 provided on the upper wall la of the fluidized-bed furnace 1 constituting the pyrolysis chamber 4. The product outlet 78 communicates with the pyrolysis chamber 4. A residue of the first raw material and a residue of the second raw material move to the main combustion chamber 6 through the communication passage 70 together with the fluidized medium. The residues combust while swirling with the fluidized medium forming the second fluidized bed 52. The residues emit thermal energy with the combustion and heat the fluidized medium forming the second fluidized bed 52 while generating a combustion exhaust gas. The combustion exhaust gas is discharged from the combustion chamber through an exhaust-gas outlet 79 provided on the upper wall la of the fluidized-bed furnace 1 constituting the main combustion chamber 6. The exhaust-gas outlet 79 communicates with the main combustion chamber 6.

A part of the heated fluidized medium overflows the upper end of the second partition wall 12, moves to the settling combustion chamber 7 through the second opening 62, and forms the third fluidized bed 53 while descending in the settling combustion chamber 7. Further, the heated fluidized medium flows into the pyrolysis chamber 4 through the first opening 61. The heated fluidized medium provides an amount of heat required for the pyrolysis, whereby the pyrolysis of the first raw material and the second raw material progresses in the pyrolysis chamber 4. The fluidized medium moved from the settling combustion chamber 7 has a high temperature, but the temperature of the fluidized medium is lowered as the fluidized medium is mixed with the first fluidized bed 51 in the pyrolysis chamber 4. In this way, the fluidized medium that has moved from the main combustion chamber 6 to the pyrolysis chamber 4 via the settling combustion chamber 7 functions as a heat source for the pyrolysis of the first raw material and the second raw material.

The first raw material in the present embodiment is a material having a high carbon content, represented by a waste of plastic produced from petroleum (hereinafter referred to as waste plastic). The second raw material is a combustible material having a lower carbon content than that of the first raw material. Examples of the second raw material may include biomass, municipal waste, sludge, organic waste, etc. The first raw material has a higher carbon content and a higher calorie than those of the second raw material. Therefore, the first raw material is more combustible than the second raw material and generates high thermal energy when the first raw material combusts. In contrast, the second raw material has a lower carbon content than that of the first raw material and usually contains a relatively large amount of water. Therefore, the second raw material is less combustible than the first raw material. In one embodiment, the first raw material may be a material (e.g., municipal waste, industrial waste, etc.) having a higher ratio of carbon to hydrogen and a higher ratio of carbon to oxygen than those of the second raw material.

The first raw material contains at least the waste plastic. The pyrolysis product generated by the pyrolysis of the first raw material includes oil obtained from the waste plastic (mainly a hydrocarbon compound containing a large amount of carbon (C) and hydrogen (H), which is liquid at normal temperature and normal pressure, etc.). The second raw material is an organic material, such as biomass, and a proportion of carbon (C), oxygen (O), and hydrogen (H) contained in the second raw material, specifically, a ratio of carbon to hydrogen (carbon/hydrogen), and a ratio of carbon to oxygen (carbon/oxygen ratio) may be lower than those of the waste plastic. Therefore, the pyrolysis product generated by the pyrolysis of the second raw material contains oxygen (O) and hydrogen (H) in addition to carbon (C). As a result, the pyrolysis product generated by the pyrolysis of the second raw material has a lower carbon (C) content than that of the pyrolysis product generated by the pyrolysis of the first raw material.

The first raw material and the second raw material do not combust in the pyrolysis chamber 4, but are pyrolyzed. Since the first raw material contains a large amount of carbon, carbide (char) is likely to be generated in the pyrolysis chamber 4.

The carbide (char) cannot be taken out as a pyrolysis product from the pyrolysis chamber 4, but has a large amount of heat. A part of the first raw material is discharged as the pyrolysis product from the pyrolysis chamber 4, and the residue of the first raw material is transported as the carbide (char) into the main combustion chamber 6. This carbide (char) has a large amount of heat. Therefore, the carbide (char) generates high thermal energy when the carbide (char) combusts in the main combustion chamber 6, and can heat the fluidized medium to a high temperature.

On the other hand, the second raw material has a lower carbon content than that of the first raw material. Therefore, if the amount of heat required for the pyrolysis of the second raw material is to be provided only by the second raw material, most of the carbon contained in the second raw material needs to be consumed in the main combustion chamber 6. As a result, the yield of the pyrolysis product generated from the second raw material is lowed. In this regard, according to the present embodiment, the first raw material containing the large amount of carbon and the second raw material containing the smaller amount of carbon are simultaneously fed into the pyrolysis chamber 4. The thermal energy generated by the combustion of the residue of the first raw material in the main combustion chamber 6 can heat sufficiently the fluidized medium in the main combustion chamber 6. Therefore, the amount of heat that the residue of the second raw material should have in the main combustion chamber 6 can be low. As a result, the yield of the pyrolysis product generated from the second raw material is improved. The heated fluidized medium moves from the main combustion chamber 6 to the pyrolysis chamber 4 through the settling combustion chamber 7, and pyrolyzes the first raw material and the second raw material.

As shown in FIG. 1, an incombustible discharge port 82 is provided between the first wind box 16 of the first gas diffuser 15 and the third wind box 36 of the third gas diffuser 35. A relatively large incombustible contained in the first raw material and/or the second raw material is discharged through the incombustibles discharge port 82.

Next, a ratio of the first raw material to the second raw material to be supplied into the pyrolysis chamber 4 will be described. As described above, the residue of the first raw material generates higher thermal energy during the combustion than the residue of the second raw material. Therefore, a ratio of a supply amount of the first raw material to a supply amount of the second raw material into the pyrolysis chamber 4 affects temperatures in the main combustion chamber 6 and the settling combustion chamber 7. The pyrolysis apparatus of the present embodiment controls the ratio of the supply amount of the first raw material to the supply amount of the second raw material to be supplied to the pyrolysis chamber 4 based on the temperature in the main combustion chamber 6. More specifically, the pyrolysis apparatus is configured to regulate the ratio of the supply amount of the first raw material to the supply amount of the second raw material into the pyrolysis chamber 4 such that the temperature in the main combustion chamber 6 is within a predetermined target range.

As shown in FIG. 1, the pyrolysis apparatus includes an operation controller 200 configured to independently control the operations of the first raw-material supply device 71 and the second raw-material supply device 72. The operation controller 200 is coupled to the first raw-material supply device 71 and the second raw-material supply device 72. The operation controller 200 is configured to control the amount of the first raw material supplied to the pyrolysis chamber 4 by the first raw-material supply device 71, and further control the amount of the second raw material supplied to the pyrolysis chamber 4 by the first raw-material supply device 71. The operation controller 200 can independently control the supply amount of the first raw material and the supply amount of the second raw material to the pyrolysis chamber 4. Therefore, the operation controller 200 can control the ratio of the supply amount of the first raw material to the supply amount of the second raw material to the pyrolysis chamber 4. Examples of the ratio of the supply amount of the first raw material to the supply amount of the second raw material include a case where the supply amount of the first raw material is zero and a case where the supply amount of the second raw material is zero.

The operation controller 200 includes a memory **200*a* storing programs therein and an arithmetic device 200*b* configured to perform arithmetic operations according to instructions contained in the programs. The memory 200*a* includes a main memory, such as a RAM, and an auxiliary memory, such as a hard disk drive (HDD) or a solid state drive (SSD). Examples of the arithmetic device 200*b* include a CPU (central processing unit) and a GPU (graphic processing unit). However, the specific configuration of the operation controller 200** is not limited to this embodiment.

The operation controller 200 is composed of at least one computer. For example, the operation controller 200 may be an edge server disposed near the fluidized-bed furnace 1 or a cloud server connected to a communication network, such as the Internet or local area network. The operation controller 200 may be a combination of a plurality of servers. For example, the operation controller 200 may be a combination of an edge server and a cloud server connected to each other by a communication network, such as the Internet or local area network.

The pyrolysis apparatus further includes a pyrolysis-chamber thermometer 85 disposed in the pyrolysis chamber 4, a main-combustion-chamber thermometer 86 disposed in the main combustion chamber 6, and a settling-combustion-chamber thermometer 87 disposed in the settling combustion chamber 7. In this embodiment, a plurality of (three in FIG. 1) pyrolysis-chamber thermometers 85 are arranged along the vertical direction in the pyrolysis chamber 4. One of the plurality of pyrolysis-chamber thermometers 85 is disposed in the freeboard section 55 in the pyrolysis chamber 4, and the other pyrolysis-chamber thermometers 85 are disposed in the first fluidized bed 51. Similarly, a plurality of (three in FIG. 1) main-combustion-chamber thermometers 86 are arranged along the vertical direction in the main combustion chamber 6, and a plurality of (three in FIG. 1) settling-combustion-chamber thermometers 87 are arranged along the vertical direction in the settling combustion chamber 7. One of the plurality of main-combustion-chamber thermometers 86 is disposed in the freeboard section 56 in the main combustion chamber 6, and the other main-combustion-chamber thermometers 86 are disposed in the second fluidized bed 52. One of the plurality of settling-combustion-chamber thermometers 87 is disposed in the freeboard section 57 in the settling combustion chamber 7, and the other settling-combustion-chamber thermometers 87 are disposed in the third fluidized bed 53.

The number and arrangement of pyrolysis-chamber thermometers 85, main-combustion-chamber thermometers 86, and settling-combustion-chamber thermometers 87 are not limited to the embodiment shown in FIG. 1. In one embodiment, a single pyrolysis-chamber thermometer 85, a single main-combustion-chamber thermometer 86, and a single settling-combustion-chamber thermometer 87 may be disposed. In another embodiment, four or more pyrolysis-chamber thermometers 85, four or more main-combustion-chamber thermometers 86, and four or more settling-combustion-chamber thermometers 87 may be disposed in the pyrolysis chamber 4, the main combustion chamber 6, and the settling combustion chamber 7, respectively.

The pyrolysis-chamber thermometers 85, the main-combustion-chamber thermometers 86, and the settling-combustion-chamber thermometers 87 measure the temperature in the pyrolysis chamber 4, the temperature in the main combustion chamber 6, and the temperature in the settling combustion chamber 7, respectively. The pyrolysis-chamber thermometers 85, the main-combustion-chamber thermometers 86, and the settling-combustion-chamber thermometers 87 are coupled to the operation controller 200. Measured values of the temperature in the pyrolysis chamber 4 are transmitted from the pyrolysis-chamber thermometers 85 to the operation controller 200, measured values of the temperature in the main combustion chamber 6 are transmitted from the main-combustion-chamber thermometers 86 to the operation controller 200, and measured values of the temperature in the settling combustion chamber 7 are transmitted from the settling-combustion-chamber thermometers 87 to the operation controller 200.

The operation controller 200 is configured to regulate the ratio of the supply amount of the first raw material to the supply amount of the second raw material to the pyrolysis chamber 4 based on the temperature in the main combustion chamber 6. More specifically, the operation controller 200 instructs at least one of the first raw-material supply device 71 and the second raw-material supply device 72 to regulate the ratio of the supply amount of the first raw material to the supply amount of the second raw material to the pyrolysis chamber 4 such that the measured value(s) of the temperature in the main combustion chamber 6 transmitted from the main-combustion-chamber thermometer(s) 86 is within a predetermined target range.

For example, when the measured value of the temperature in the main combustion chamber 6 falls below the above target range, the operation controller 200 instructs the first raw-material supply device 71 to increase the supply amount of the first raw material to the pyrolysis chamber 4. At the same time, the operation controller 200 may instruct the second raw-material supply device 72 to reduce the supply amount of the second raw material to the pyrolysis chamber 4. In another example, when the measured value of the temperature in the main combustion chamber 6 exceeds the above target range, the operation controller 200 instructs the second raw-material supply device 72 to increase the supply amount of the second raw material to the pyrolysis chamber 4. At the same time, the operation controller 200 may instruct the first raw-material supply device 71 to reduce the supply amount of the first raw material to the pyrolysis chamber 4. The supply amount of the first raw material or the supply amount of the second raw material may be zero.

According to the present embodiment, the first raw-material supply device 71 and the second raw-material supply device 72 can feed the first raw material having a high carbon content and the second raw material having a low carbon content to the pyrolysis chamber 4 at an appropriate ratio. The pyrolysis in the pyrolysis chamber 4 and the combustion in the main combustion chamber 6 are optimized, and as a result, the yield of the pyrolysis product in the pyrolysis chamber 4 is improved.

Under a condition where a circulating flow rate of the fluidized medium between the pyrolysis chamber 4 and the main combustion chamber 6 is constant, the temperature of the pyrolysis chamber 4 depends on the temperature of the fluidized medium transferred from the main combustion chamber 6 via the settling combustion chamber 7. Specifically, when the temperature in the main combustion chamber 6 is high, the temperature in the pyrolysis chamber 4 also rises. The type of pyrolysis product generated in the pyrolysis chamber 4 depends on the temperature in the pyrolysis chamber 4. For example, the temperature in the pyrolysis chamber 4 suitable for recovering the oil is 200° C. or higher, preferably 250° C. or higher, more preferably 300° C. or higher, and 600° C. or lower, preferably 500° C. or lower, more preferably 400° C. or lower. The temperature in the pyrolysis chamber 4 suitable for recovering a high-calorie fuel gas, such as a hydrocarbon gas, is preferably as low as possible within a range of 600° C. to 900° C. The temperature in the pyrolysis chamber 4 suitable for recovering a synthetic gas of hydrogen and carbon monoxide is preferably as high as possible within a range of 900° C. to 1300° C. The temperature of the pyrolysis chamber 4 may be secured by supplying an oxidizing agent to the freeboard section 55 of the pyrolysis chamber 4. The oxidizing agent may be air, oxygen, or a combination of oxygen and vapor.

The pyrolysis apparatus of the embodiment shown in FIG. 1 can selectively recover the oil, the fuel gas, or the synthetic gas. For example, in order to increase the yield of the oil, the first raw material and the second raw material are supplied into the pyrolysis chamber 4 with a low ratio of the supply amount of the first raw material to the supply amount of the second raw material. The first raw material contains waste plastic which is a high-calorie material, while the second raw material is a relatively low-calorie material, such as biomass or municipal waste.

First, the first raw material is pyrolyzed in the pyrolysis chamber 4, and then the residue of the first raw material (char which is a carbide) is transferred to the main combustion chamber 6. The residue of the first raw material is a high-calorie material containing a large amount of carbide, but the amount of the residue of the first raw material supplied to the main combustion chamber 6 is relatively small. Therefore, the temperature in the main combustion chamber 6 does not rise so much. As a result, the temperature in the pyrolysis chamber 4 is 600° C. or lower, which is suitable for recovering the oil from the waste plastic.

In order to increase the yield of the fuel gas (e.g., the hydrocarbon gas), the first raw material and the second raw material are supplied into the pyrolysis chamber 4 with a high ratio of the supply amount of the first raw material to the supply amount of the second raw material. The first raw material is pyrolyzed in the pyrolysis chamber 4, and then the residue of the first raw material (char which is a carbide) is transferred to the main combustion chamber 6. Since the amount of the residue of the first raw material supplied to the main combustion chamber 6 is relatively large, the temperature in the main combustion chamber 6 rises. As a result, the temperature in the pyrolysis chamber 4 is in a range of 600° C. to 900° C. which is suitable for generating the hydrocarbon gas.

In order to increase the yield of the synthetic gas of hydrogen and carbon monoxide, the first raw material and the second raw material are supplied into the pyrolysis chamber 4 with a further higher ratio of the supply amount of the first raw material to the supply amount of the second raw material. The first raw material is pyrolyzed in the pyrolysis chamber 4, and then the residue of the first raw material (char which is a carbide) is transferred to the main combustion chamber 6. Since the amount of the residue of the first raw material supplied to the main combustion chamber 6 is considerably large, the temperature in the main combustion chamber 6 rises. As a result, the temperature in the pyrolysis chamber 4 is in a range of 900° C. to 1300° C. which is suitable for generating the hydrocarbon gas.

In this way, the operation controller 200 can regulate the temperature of the pyrolysis chamber 4 and can increase the yield of the intended pyrolysis product by controlling the operations of the first raw-material supply device 71 and the second raw-material supply device 72 (i.e., regulating the ratio of the supply amount of the first raw material to the supply amount of the second raw material to the pyrolysis chamber 4).

In the above-described embodiment, the operation controller 200 controls the operations of the first raw-material supply device 71 and the second raw-material supply device 72 based on the temperature in the main combustion chamber 6 (i.e., the measured value(s) of the temperature transmitted from the main-combustion-chamber thermometer(s) 86). In one embodiment, the operation controller 200 may control the operations of the first raw-material supply device 71 and the second raw-material supply device 72 based on the temperature in the settling combustion chamber 7 (i.e., the measured value(s) of the temperature transmitted from the settling-combustion-chamber thermometer(s) 87).

Figure 2:
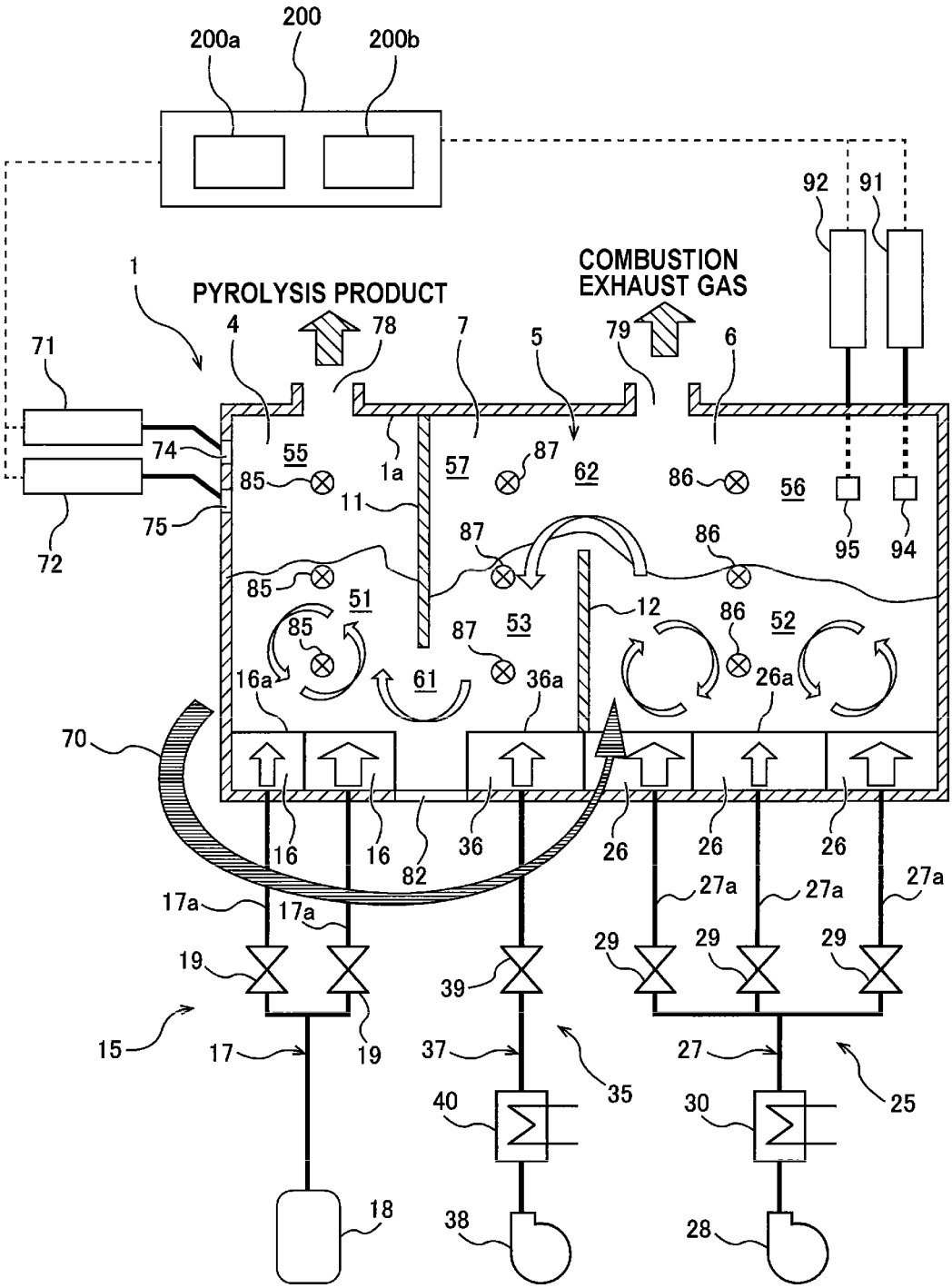
FIG. 2 is a diagram showing another embodiment of the pyrolysis apparatus.

In one embodiment, as shown in FIG. 2, the pyrolysis apparatus may further include a third raw-material supply device 91 and a fourth raw-material supply device 92 configured to supply the first raw material and the second raw material into the main combustion chamber 6. A raw-material outlet of the third raw-material supply device 91 is coupled to the main combustion chamber 6, and a raw-material inlet of the third raw-material supply device 91 is coupled to a transporting device (not shown) configured to transport the first raw material. Similarly, a raw-material outlet of the fourth raw-material supply device 92 is coupled to the main combustion chamber 6, and a raw-material inlet of the fourth raw-material supply device 92 is coupled to a transporting device (not shown) configured to transport the second raw material. Specific examples of the third raw-material supply device 91 and the fourth raw-material supply device 92 include a screw feeder capable of quantitatively feeding the raw material into the main combustion chamber 6.

In the embodiment shown in FIG. 2, the first raw material and the second raw material are fed from the third raw-material supply device 91 and the fourth raw-material supply device 92 through two supply ports 94 and 95 provided in the freeboard section 56 of the main combustion chamber 6 into the main combustion chamber 6. In FIG. 2, the supply ports 94 and 95 are schematically illustrated. In one embodiment, the first raw material and the second raw material may be mixed after being delivered from the third raw-material supply device 91 and the fourth raw-material supply device 92, and the mixture of the first raw material and the second raw material may be fed through one supply port into the main combustion chamber 6.

The operation controller 200 is coupled to the third raw-material supply device 91 and the fourth raw-material supply device 92. In the present embodiment, the operation controller 200 is configured to control the operations of the third raw-material supply device 91 and the fourth raw-material supply device 92 in addition to the operations of the first raw-material supply device 71 and the second raw-material supply device 72. Specifically, the operation controller 200 is configured to control the amount of the first raw material supplied to the main combustion chamber 6 by the third raw-material supply device 91, and further control the amount of the second raw material supplied to the main combustion chamber 6 by the fourth raw-material supply device 92. The operation controller 200 can control independently the amount of the first raw material and the amount of the second raw material supplied to the main combustion chamber 6. Therefore, the operation controller 200 can control the ratio of the amount of the first raw material to the amount of the second raw material supplied to the main combustion chamber 6.

During the operation of the pyrolysis apparatus, the first raw-material supply device 71 and the second raw-material supply device 72 supply continuously the first raw material and the second raw material into the pyrolysis chamber 4, while the third raw-material supply device 91 and the fourth raw-material supply device 92 supply at least one of the first raw material and the second raw material into the main combustion chamber 6 when necessary. For example, when the measured value of the temperature in the main combustion chamber 6 falls below a predetermined lower limit value which is lower than the above target range, the operation controller 200 instructs the third raw-material supply device 91 to supply the first raw material into the combustion chamber 6. At this time, the operation controller 200 may also instruct the fourth raw-material supply device 92 to supply the second raw material into the main combustion chamber 6. In another example, when the measured value of the temperature in the main combustion chamber 6 falls below the above lower limit value, the operation controller 200 instructs the fourth raw-material supply device 92 to supply the second raw material into the main combustion chamber 6. At this time, the operation controller 200 may also instruct the third raw-material supply device 91 to supply the first raw material into the main combustion chamber 6.

In the present embodiment, at least one of the first raw material and the second raw material is directly fed into the main combustion chamber 6 and immediately combusts. Therefore, the temperature in the main combustion chamber 6 rises, and the temperature can quickly reach the above target range.

In one embodiment, the operation controller 200 may control the operations of the third raw-material supply device 91 and the fourth raw-material supply device 92 based on the temperature in the settling combustion chamber 7 (i.e., the measured value(s) of the temperature transmitted from the settling-combustion-chamber thermometer(s) 87).

Further, in one embodiment, the operation controller 200 may control the operation of at least one of the third raw-material supply device 91 and the fourth raw-material supply device 92, instead of controlling the operations of the first raw-material supply device 71 and the second raw-material supply device 72, such that the measured value of the temperature in the main combustion chamber 6 or the settling combustion chamber 7 is maintained within the above target range. Specifically, while the first raw-material supply device 71 and the second raw-material supply device 72 supply the first raw material and the second raw material into the pyrolysis chamber 4 in fixed supply amounts, the operation controller 200 may control the operation of at least one of the third raw-material supply device 91 and the fourth raw-material supply device 92 to supply at least one of the first raw material and the second raw material to the main combustion chamber 6, so that the measured value of the temperature in the main combustion chamber 6 or the settling combustion chamber 7 is within the above target range. According to such operation, the pyrolysis apparatus can control the temperature in the main combustion chamber 6 independently of the ratio of the first raw material to the second raw material in the pyrolysis chamber 4.

Figure 3:
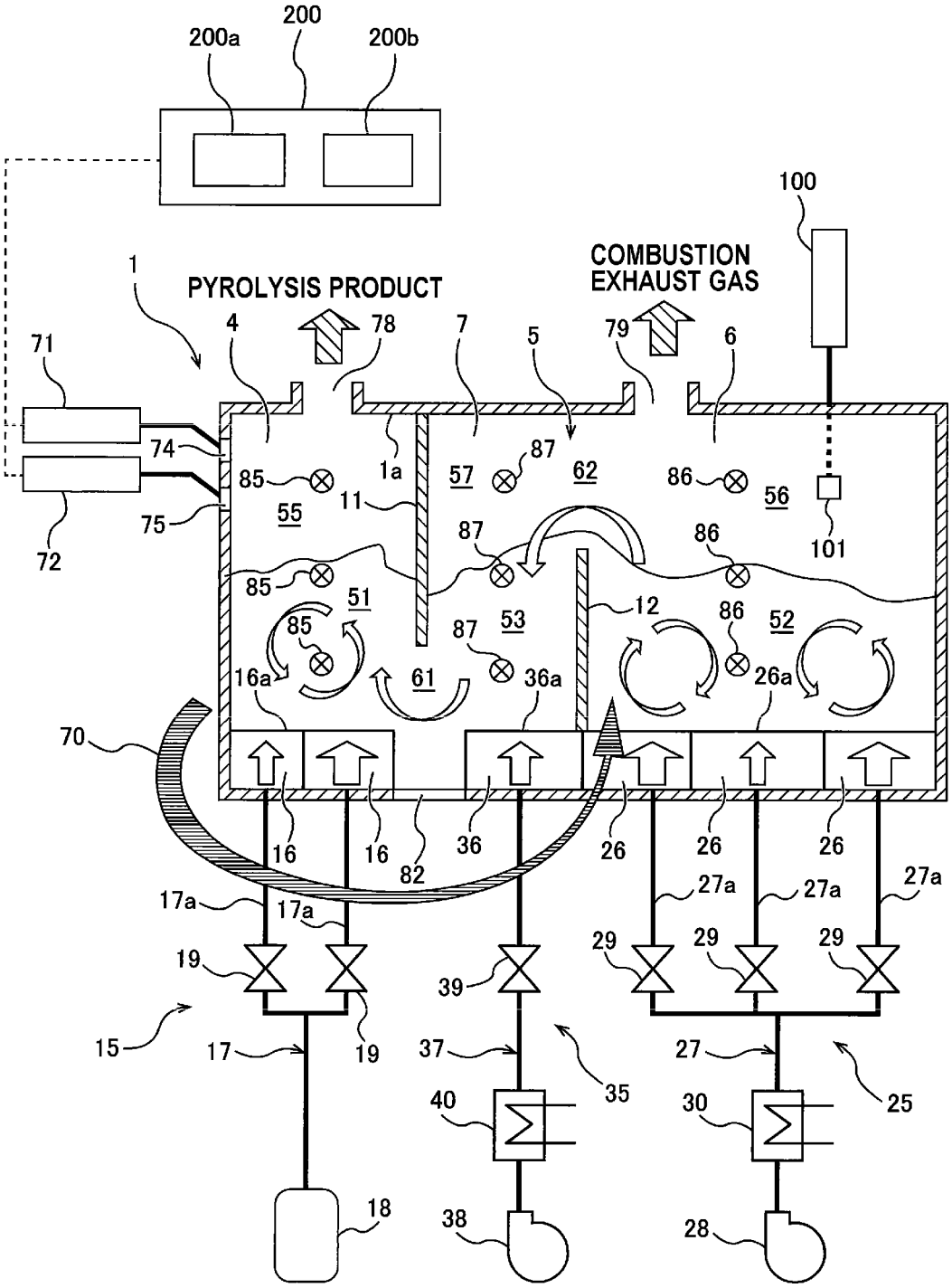
FIG. 3 is a diagram showing still another embodiment of the pyrolysis apparatus.

In one embodiment, as shown in FIG. 3, the pyrolysis apparatus may further include a harmful-material supply device 100 configured to supply a harmful material containing a volatile repellent substance to the main combustion chamber 6. A material outlet of the harmful-material supply device 100 is coupled to the main combustion chamber 6, and a material inlet of the harmful-material supply device 100 is coupled to a transporting device (not shown) configured to transport the harmful material. The harmful material is fed into the main combustion chamber 6 from a supply port 101 provided in the freeboard section 56 of the main combustion chamber 6. Specific examples of the harmful-material supply device 100 include a screw feeder capable of quantitatively feeding the harmful material into the main combustion chamber 6.

The volatile repellent substance combusts in the main combustion chamber 6, and a combustion exhaust gas is generated. The combustion exhaust gas is discharged from the main combustion chamber 6 through the exhaust-gas outlet 79. Since the volatile repellent substance does not move into the pyrolysis chamber 4, the volatile repellent substance does not mix with the pyrolysis product generated in the pyrolysis chamber 4.

The pyrolysis apparatus of the embodiment shown in FIGS. 1 to 3 can discharge various pyrolysis products (oil, hydrocarbon, etc.), derived from the first raw material and the second raw material, from the pyrolysis chamber 4. These pyrolysis products can be used in products, such as petroleum products or fuels. Recently, there is an increasing demand for a treatment system capable of emitting a wider variety of chemical substances.

Figure 4:
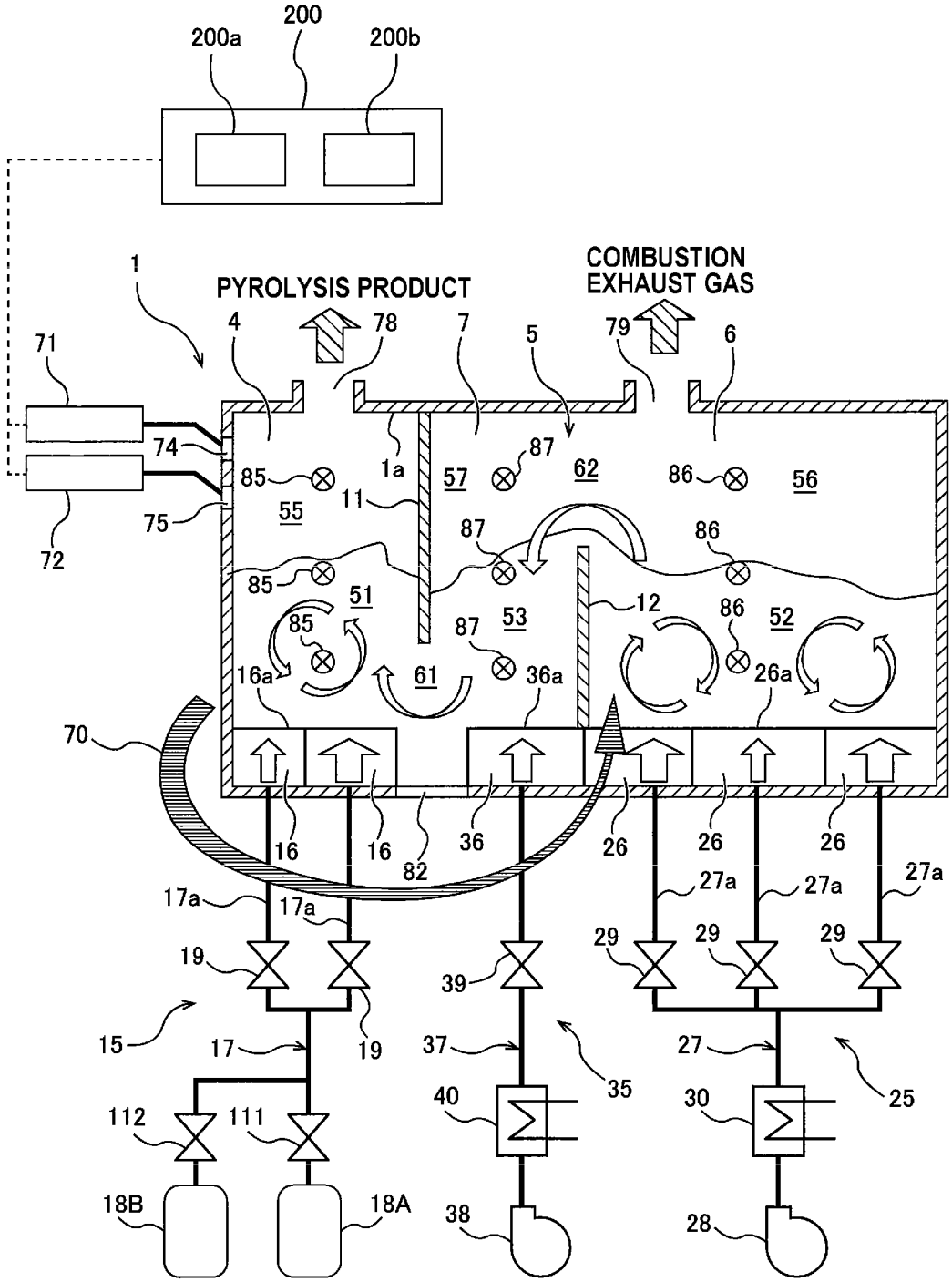
FIG. 4 is a diagram showing still another embodiment of the pyrolysis apparatus.

Thus, next, an embodiment of the pyrolysis apparatus capable of emitting other chemical substance as the pyrolysis product in addition to the substances derived from the first raw material and the second raw material will be described. As shown in FIG. 4, the first gas diffuser 15 includes a plurality of (two in the example of FIG. 4) first fluidizing-gas supply sources 18A and 18B coupled to the first fluidizing-gas supply line 17, and a plurality of (two in the example of FIG. 4) on-off valves 111 and 112 disposed downstream of the plurality of first fluidizing-gas supply sources 18A and 18B.

One of the first fluidizing-gas supply sources 18A and 18B is a main supply source 18A for supplying water vapor or air, and the other one is an additive-gas supply source 18B for supplying additive gas. In this embodiment, the main supply source 18A is constituted by a boiler configured to generate water vapor. In one embodiment, the main supply source 18A may be constituted by a blower configured to deliver air. Further, in one embodiment, the main supply source 18A may not be provided. The additive gas is any one of carbon monoxide gas, carbon dioxide gas, hydrogen gas, hydrocarbon gas, and nitrogen gas. The plurality of first fluidizing-gas supply sources 18A and 18B may include a plurality of additive-gas sources for supplying multiple types of additive gases selected from carbon monoxide gas, carbon dioxide gas, hydrogen gas, hydrocarbon gas, and nitrogen gas. The additive gas may be obtained from the pyrolysis product.

The on-off valves 111 and 112 are disposed downstream of the main supply source 18A and the additive-gas supply source 18B, respectively. These on-off valves 111 and 112 are coupled to the operation controller 200, and open-close operations of the on-off valves 111 and 112 are controlled by the operation controller 200. When the operation controller 200 opens all the on-off valves 111 and 112, a mixture of the water vapor and the additive gas is supplied as the first fluidizing gas to the pyrolysis chamber 4 through the first fluidizing-gas supply line 17. When the operation controller 200 opens the on-off valve 111 while closing the on-off valve 112, only the water vapor is supplied as the first fluidizing gas to the pyrolysis chamber 4 through the first fluidizing-gas supply line 17. When the operation controller 200 closes the on-off valve 111 while opening the on-off valve 112, only the additive gas is supplied as the first fluidizing gas to the pyrolysis chamber 4 through the first fluidizing-gas supply line 17. Examples of the first fluidizing gas include a mixture of water vapor and hydrogen gas, hydrogen gas only, etc. When a plurality of additive-gas supply sources 18B are provided, the first fluidizing gas may be a mixture of water vapor, hydrogen gas, and carbon monoxide, a mixture of hydrogen gas and carbon monoxide, etc. When the main supply source 18A is a blower, air instead of water vapor constitutes at least a part of the first fluidizing gas.

When the above-described combination of the first raw material and the second raw material is fed into the pyrolysis chamber 4, the proportion of carbon contained in the pyrolysis product is relatively high. In such a case, in one example, in order to balance the content of carbon and hydrogen in the pyrolysis product, only hydrogen gas or a combination of water vapor and hydrogen gas is used as the first fluidizing gas. At least a part of the hydrogen is used for the pyrolysis of the raw material in the pyrolysis chamber 4, and is discharged from the pyrolysis chamber 4 as a pyrolysis product. In this manner, in the present embodiment, the first fluidizing gas containing required chemical substance is used. As a result, the pyrolysis product can contain desired chemical substance.

The embodiments shown in FIGS. 1 to 4 can be combined appropriately. For example, the embodiment shown in FIG. 3 may be combined with the embodiment shown in FIG. 2. The embodiment shown in FIG. 4 may be combined with the embodiments shown in FIGS. 2 and 3.

Figure 5:
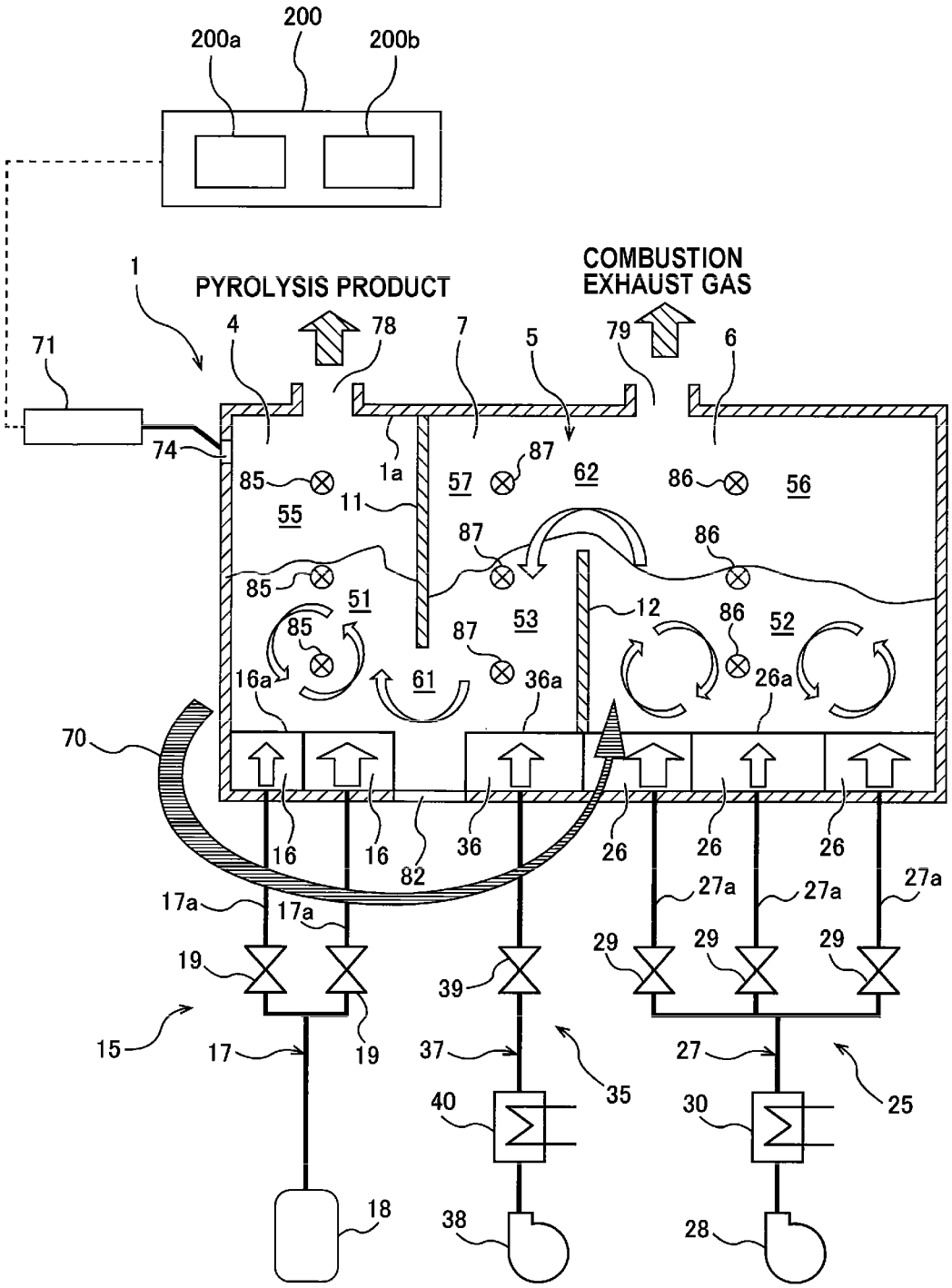
FIG. 5 is a diagram showing still another embodiment of the pyrolysis apparatus.

Next, an embodiment of the pyrolysis apparatus suitable for recovering oil from the raw material will be described with reference to FIG. 5. Configurations and operations of this embodiment, which will not be particularly described, are the same as those of the embodiment described with reference to FIG. 1, and duplicated description will be omitted. In the embodiment shown in FIG. 5, the pyrolysis apparatus includes a raw-material supply device 71 for supplying the first raw material into the pyrolysis chamber 4. This raw-material supply device 71 corresponds to the first raw-material supply device 71 shown in FIG. 1. In the following description, the first raw material is simply referred to as raw material. This raw material is of the same type as the first raw material described above, and contains at least the waste plastic having a high carbon content. In the present embodiment, a component corresponding to the second raw-material supply device 72 of FIG. 1 is not provided, but the second raw-material supply device 72 shown in FIG. 1 for supplying the second raw material into the pyrolysis chamber 4 may be provided.

The raw material does not combust in the pyrolysis chamber 4, and a residue of the raw material (e.g., char) combusts in the main combustion chamber 6 and the settling combustion chamber 7. The fluidized medium in the main combustion chamber 6 and the settling combustion chamber 7 is heated by the combustion of the residue of the raw material and flows into the pyrolysis chamber 4 through the first opening 61. The heat of the heated fluidized medium is removed while being mixed with the first fluidized bed 51 in the pyrolysis chamber 4, and the first fluidized bed 51 settles at a certain temperature. The temperature in the pyrolysis chamber 4 suitable for recovering oil from the waste plastic is 600° C. or lower. Therefore, the temperature in the pyrolysis chamber 4 is maintained at 600° C. or lower.

However, the fluidized medium that has just moved from the settling combustion chamber 7 to the pyrolysis chamber 4 has a high temperature, and a high temperature region is locally present inside the pyrolysis chamber 4. For example, although the overall temperature in the pyrolysis chamber 4 is maintained at 600° C. or lower, the temperature near the first opening 61 may exceed 800° C. When the high temperature region is locally present, the waste plastic in the high temperature region is excessively decomposed into carbide (char) and light gas, and as a result, the yield of the oil may be lowered.

Thus, in the present embodiment, the temperature of the fluidized medium in the settling combustion chamber 7 is regulated to a temperature suitable for obtaining the oil from the raw material in the pyrolysis chamber 4. The operation controller 200 is configured to control at least one of the temperature and the flow rate of the third fluidizing gas supplied into the settling combustion chamber 7 based on the temperature in the settling combustion chamber 7. Specifically, the operation controller 200 operates at least one of the third temperature regulator 40 and the third gas flow-rate regulating valve 39 of the third gas diffuser 35 to regulate at least one of the temperature and the flow rate of the third fluidizing gas supplied into the settling combustion chamber 7 such that the measured value of the temperature in the settling combustion chamber 7 is within a predetermined temperature range. The measured value(s) of the temperature in the settling combustion chamber 7 is transmitted from the settling-combustion-chamber thermometer(s) 87 to the operation controller 200.

The temperature of the third fluidizing gas itself is lower than the temperature of the fluidized medium in the settling combustion chamber 7. Therefore, when the operation controller 200 operates the third temperature regulator 40 to further lower the temperature of the third fluidizing gas, the temperature of the fluidized medium in the settling combustion chamber 7 is lowered. Similarly, when the operation controller 200 operates the third gas flow-rate regulating valve 39 to increase the flow rate of the third fluidizing gas, the temperature of the fluidized medium in the settling combustion chamber 7 is lowered. The operation controller 200 may operate both the third temperature regulator 40 and the third gas flow-rate regulating valve 39 to further lower the temperature of the third fluidizing gas, and increase the flow rate of the third fluidizing gas.

After such optimization of the temperature of the fluidized medium, the fluidized medium flows into the pyrolysis chamber 4 through the first opening 61. While the fluidized medium swirls in the pyrolysis chamber 4 and forms the first fluidized bed 51, the fluidized medium maintains the temperature in the pyrolysis chamber 4 in a temperature range that can achieve a high yield of the oil component. The raw material containing the waste plastic is heated while being agitated by the swirling flow of the fluidized medium, and vaporized oil is generated. The vaporized oil is discharged as the pyrolysis product from the pyrolysis chamber 4 through the product outlet 78.

According to the present embodiment, the temperature of the fluidized medium is regulated in advance, and then the fluidized medium moves to the pyrolysis chamber 4. Therefore, a local high-temperature region is not formed in the pyrolysis chamber 4. As a result, a uniform pyrolysis reaction temperature field is formed, and the yield of the intended pyrolysis product can be improved.

Figure 6:
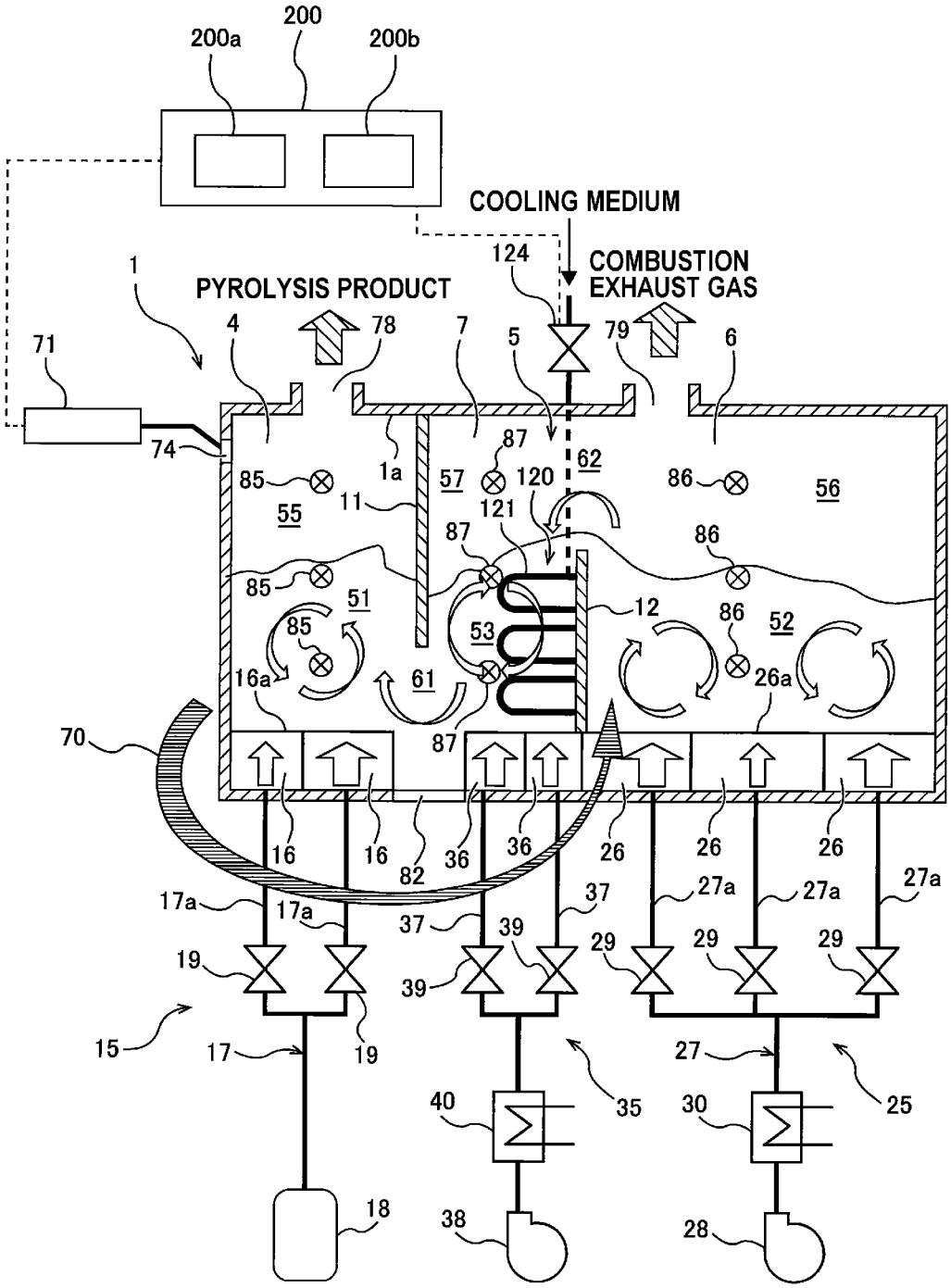
FIG. 6 is a diagram showing still another embodiment of the pyrolysis apparatus.

FIG. 6 is a diagram showing another embodiment of the pyrolysis apparatus suitable for obtaining an intended pyrolysis product from the raw material. Configurations and operations of this embodiment, which will not be particularly described, are the same as those of the embodiment shown in FIG. 5, and duplicated description will be omitted.

As shown in FIG. 6, the pyrolysis apparatus of this embodiment includes a heat recovery device 120 configured to recover heat from the fluidized medium in the settling combustion chamber 7. The heat recovery device 120 has a heat transfer tube 121 through which a cooling medium, such as water, flows, and a refrigerant flow-rate regulating valve 124 attached to the heat transfer tube 121. The heat transfer tube 121 is disposed in the settling combustion chamber 7. More specifically, the heat transfer tube 121 protrudes into the settling combustion chamber 7. The heat recovery device 120 can recover the heat from the fluidized medium in the settling combustion chamber 7 and can lower the temperature of the fluidized medium. Specifically, the heat of the fluidized medium in the settling combustion chamber 7 is transferred to the cooling medium flowing in the heat transfer tube 121, and as a result, the temperature of the fluidized medium is lowered.

The refrigerant flow-rate regulating valve 124 is coupled to the operation controller 200, and the operation of the refrigerant flow-rate regulating valve is controlled by the operation controller 200. The operation controller 200 operates the refrigerant flow-rate regulating valve 124, and controls the flow rate of the cooling medium flowing through the heat transfer tube 121 such that the measured value(s) of the temperature transmitted from the settling-combustion-chamber thermometer(s) 87 (i.e., the temperature in the settling combustion chamber 7) is within a predetermined temperature range.

In order to ensure the contact of the fluidized medium in the settling combustion chamber 7 and the heat transfer tube 121, the third gas diffuser 35 includes a plurality of third wind boxes 36, a plurality of third fluidizing-gas supply lines 37 coupled to these third wind boxes 36, respectively, and a plurality of third gas flow-rate regulating valves (or a plurality of third gas flow-rate regulating dampers) 39 attached to these third fluidizing-gas supply lines 37, respectively. The operation controller 200 is configured to control the operations of the plurality of third gas flow-rate regulating valves 39 such that opening degrees of the plurality of third gas-flow rate regulating valves 39 are different from each other. Since the opening degrees of the third gas flow-rate regulating valves 39 are different, the flow rates of the third fluidizing gas blown out from the plurality of third wind boxes 36 are also different from each other. These third fluidizing gases with different flow rates are supplied into the settling combustion chamber 7, and the fluidized medium forming the third fluidized bed 53 swirls.

A part of the swirling flow of the fluidized medium contacts the heat transfer tube 121 of the heat recovery device 120, and as a result, the temperature of the fluidized medium is lowered. Further, since the swirling flow of the fluidized medium makes the temperature of the fluidized medium uniform in the settling combustion chamber 7, the movement of the high-temperature fluidized medium to the pyrolysis chamber 4 can be prevented. Furthermore, the flow rate of the fluidized medium from the settling combustion chamber 7 to the pyrolysis chamber 4 can be controlled by strength or direction of the swirling flow of the fluidized medium. Furthermore, a heat transfer coefficient between the fluidized medium and the heat transfer tube 121 can be changed by the regulation of the strength of the swirling flow of the fluidized medium, which is achieved by the regulation of the flow rate of the third fluidizing gas blown out from the plurality of third wind boxes 36. Such a change in the heat transfer coefficient can change an amount of heat absorption through the heat transfer tube 121, and can thus regulate the temperature of the fluidized medium flowing from the settling combustion chamber 7 to the pyrolysis chamber 4.

Figure 7:
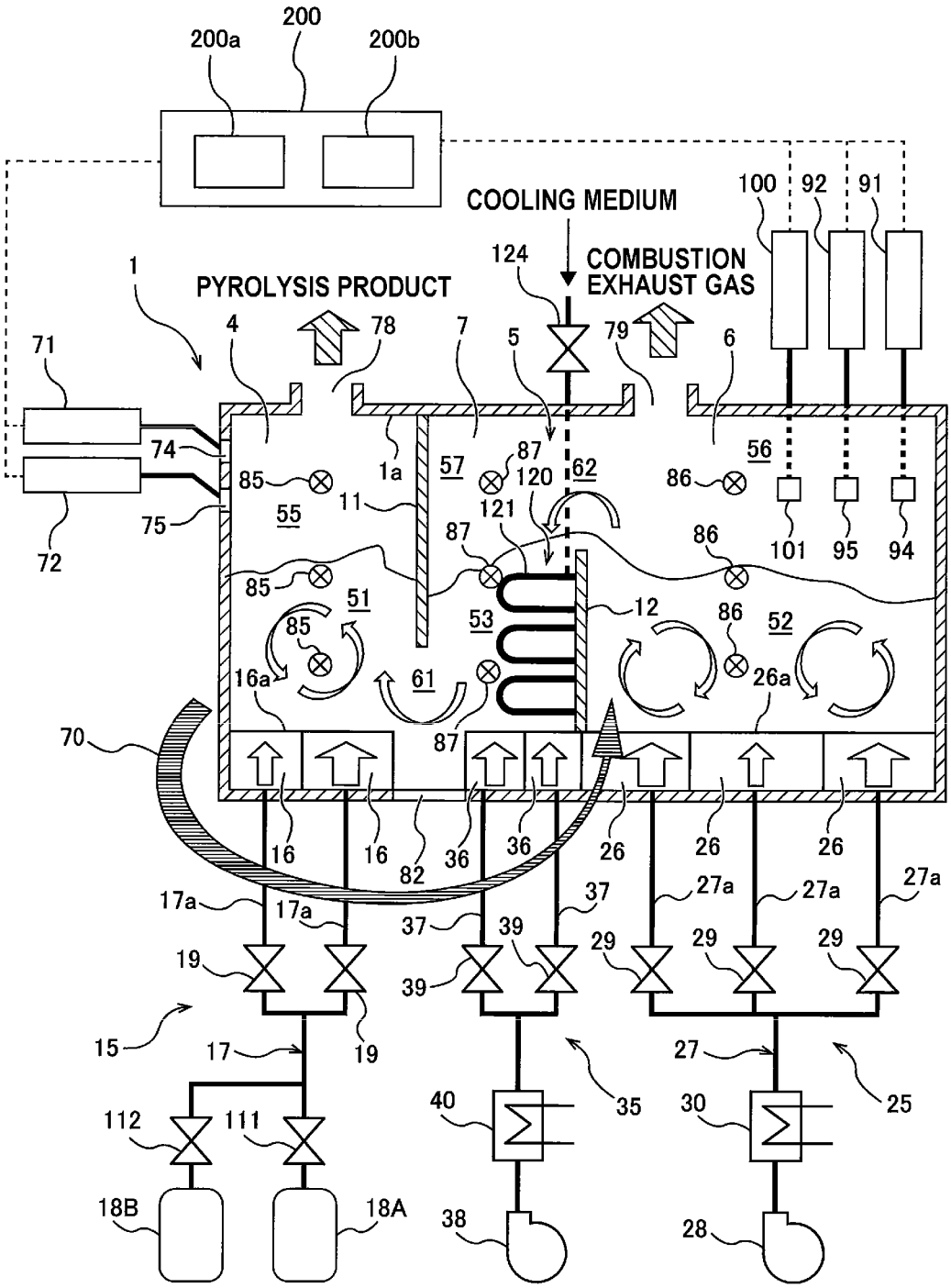
FIG. 7 is a diagram showing still another embodiment of the pyrolysis apparatus.

The embodiments described with reference to FIGS. 1 to 6 can be combined appropriately. For example, the embodiment shown in FIG. 5 can be applied to any of the embodiments shown in FIGS. 1 to 4. Further, the heat recovery device 120 and the third gas diffuser 35 shown in FIG. 6 can be combined with any of the embodiments shown in FIGS. 1 to 4. Furthermore, as shown in FIG. 7, all the embodiments shown in FIGS. 1 to 6 may be combined.

Appropriate combination of the embodiments described with reference to FIGS. 1 to 6 can achieve an efficient combustion operation while increasing the yield of the intended pyrolysis product. Furthermore, a wide variety of chemical substances can be recovered in high yields.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments.

Therefore, the present invention is not intended to be limited to the embodiments described herein but is to be accorded the widest scope as defined by limitation of the claims.

INDUSTRIAL APPLICABILITY

The present invention is applicable to a pyrolysis apparatus and a pyrolysis method for pyrolyzing a raw material in a fluidized-bed furnace, and more particularly to a pyrolysis apparatus and a pyrolysis method for pyrolyzing a raw material using an internally circulating fluidized-bed gasification technique to obtain a pyrolysis product.

REFERENCE SIGNS LIST

1 fluidized-bed furnace
4 pyrolysis chamber
5 combustion chamber
6 main combustion chamber
7 settling combustion chamber
11 first partition wall
12 second partition wall
15 first gas diffuser
16 first wind box
17 first fluidizing-gas supply line
18, 18A, 18B first fluidizing-gas supply source
19 first gas flow-rate regulating valve
25 second gas diffuser
26 second wind box
27 second fluidizing-gas supply line
28 second fluidizing-gas supply source
29 second gas flow-rate regulating valve
30 second temperature regulator
35 third gas diffuser
36 third wind box
37 third fluidizing-gas supply line
38 third fluidizing-gas supply source
39 third gas flow-rate regulating valve
40 third temperature regulator
51 first fluidized bed
52 second fluidized bed
53 third fluidized bed
55, 56, 57 freeboard section
61 first opening
62 second opening
70 communication passage
71 first raw-material supply device
72 second raw-material supply device
74, 75 supply port
78 product outlet
79 exhaust-gas outlet
82 incombustible discharge port
85 pyrolysis-chamber thermometer
86 main-combustion-chamber thermometer
87 settling-combustion-chamber thermometer
91 third raw-material supply device
92 fourth raw-material supply device
94, 95 supply port
100 harmful-material supply device
101 supply port
111, 112 on-off valve
120 heat recovery device
121 heat transfer tube
124 refrigerant flow-rate regulating valve
200 operation controller

The invention claimed is:

1. A pyrolysis apparatus for pyrolyzing a raw material in a fluidized bed formed of a fluidized medium, comprising:

a fluidized-bed furnace;

a first partition wall dividing inside of the fluidized-bed furnace into a pyrolysis chamber and a combustion chamber;

a second partition wall dividing the combustion chamber into a main combustion chamber and a settling combustion chamber;

a first gas diffuser, a second gas diffuser, and a third gas diffuser configured to supply a first fluidizing gas, a second fluidizing gas, and a third fluidizing gas to the pyrolysis chamber, the main combustion chamber, and the settling combustion chamber, respectively;

a first raw-material supply device configured to supply a first raw material to the pyrolysis chamber with a first supply amount;

a second raw-material supply device configured to supply a second raw material to the pyrolysis chamber with a second supply amount, the second raw material having a lower ratio of carbon to hydrogen and a lower ratio of carbon to oxygen than those of the first raw material; and an operation controller configured to independently control operations of the first raw-material supply device and the second raw-material supply device and configured to regulate a ratio of the first supply amount to second supply amount based on a temperature in the main combustion chamber or a temperature in the settling combustion chamber.

2. The pyrolysis apparatus according to claim 1, further comprising:

a third raw-material supply device configured to supply the first raw material to the main combustion chamber; and a fourth raw-material supply device configured to supply the second raw material to the main combustion chamber.

3. The pyrolysis apparatus according to claim 1, wherein the operation controller is configured to control an operation of the third gas diffuser such that a temperature in the settling combustion chamber is within a predetermined temperature range.

4. The pyrolysis apparatus according to claim 3, wherein the third gas diffuser includes:

a wind box disposed under the settling combustion chamber;

a fluidizing-gas supply line coupled to the wind box;

a temperature regulator attached to the fluidizing-gas supply line; and a gas flow-rate regulating valve attached to the fluidizing-gas supply line, and the operation controller is configured to control an operation of at least one of the temperature regulator and the gas flow-rate regulating valve such that the temperature in the settling combustion chamber is within the predetermined temperature range.

5. The pyrolysis apparatus according to claim 1, further comprising a heat recovery device configured to recover heat from a fluidized medium in the settling combustion chamber, wherein the operation controller is configured to control an operation of the heat recovery device such that a temperature in the settling combustion chamber is within a predetermined temperature range.

6. The pyrolysis apparatus according to claim 5, wherein the heat recovery device includes:

a heat transfer tube disposed in the settling combustion chamber; and a refrigerant flow-rate regulating valve configured to regulate a flow rate of a cooling medium flowing in the heat transfer tube, and the operation controller is configured to control an operation of the refrigerant flow-rate regulating valve such that the temperature in the settling combustion chamber is within the predetermined temperature range.

7. The pyrolysis apparatus according to claim 5, wherein the third gas diffuser includes:

a plurality of wind boxes disposed under the settling combustion chamber;

a plurality of fluidizing-gas supply lines coupled to the plurality of wind boxes, respectively; and a plurality of gas flow-rate regulating valves attached to the plurality of fluidizing-gas supply lines, respectively, and the operation controller is configured to control operations of the plurality of gas flow-rate regulating valves such that opening degrees of the plurality of gas flow- rate regulating valves are different from each other.

8. The pyrolysis apparatus according to claim 1, wherein the first gas diffuser includes at least one first fluidizing-gas supply source configured to supply the first fluidizing gas to the pyrolysis chamber, and the first fluidizing-gas supply source includes at least one supply source configured to supply at least one of carbon monoxide gas, carbon dioxide gas, hydrogen gas, hydrocarbon gas, vapor, and nitrogen gas.

* * * * *